US005979098A

United States Patent [19]

Griggs

[11] Patent Number: 5,979,098

[45] Date of Patent: Nov. 9, 1999

[54] RECOIL ABSORBER AND REDIRECTOR MECHANISM FOR GUN STOCK

[76] Inventor: Jay P. Griggs, P.O. Box 789, Bountiful, Utah 84011

[21] Appl. No.: 09/100,955

[22] Filed: Jun. 22, 1998

[51] Int. Cl.[6] ..... F41C 23/06

[52] U.S. Cl. ..... 42/73; 42/74

[58] Field of Search ..... 42/73, 74

[56] References Cited

U.S. PATENT DOCUMENTS

| | | | |
|---|---|---|---|
| 169,465 | 11/1875 | Miller | 42/74 |
| 1,088,362 | 2/1914 | Perkins | 42/74 |
| 1,213,951 | 1/1917 | Ringsmith | 42/74 |
| 1,468,354 | 9/1923 | Caretto | 42/74 |
| 1,480,350 | 1/1924 | Martin et al. | 42/74 |
| 2,453,394 | 11/1948 | Wittman | 42/73 |
| 2,787,855 | 4/1957 | Guymon | 42/73 |
| 3,207,496 | 9/1965 | Hrebicek | 267/1 |
| 3,388,494 | 6/1968 | Kimball | 42/74 |
| 3,754,344 | 8/1973 | Spiliotis | 42/74 |
| 4,316,342 | 2/1982 | Griggs | 42/74 |
| 4,922,641 | 5/1990 | Johnson | 42/74 |
| 5,001,855 | 3/1991 | Griggs | 42/74 |
| 5,752,339 | 5/1998 | Bentley et al. | 42/74 |

FOREIGN PATENT DOCUMENTS 1500181 9/1967 France .

*Primary Examiner*—Charles T. Jordan
*Assistant Examiner*—Denise J. Buckley
*Attorney, Agent, or Firm*—Warren F. B. Lindsley

[57] ABSTRACT

An improved recoil absorber and redirector mechanism for a shoulder held gun stock which reduces the effects of recoil by causing one of two normally aligned members mounted on the butt end of a gun stock to move laterally of the other under recoil thereby redirecting the forces of recoil with the movable member resiliently absorbing most of and/or delay the recoil energy which is later used to reset the mechanism to its normal inactive position.

7 Claims, 2 Drawing Sheets

RECOIL ABSORBER AND REDIRECTOR MECHANISM FOR GUN STOCK

BACKGROUND OF THE INVENTION

This invention relates to recoil absorber and redirector mechanisms for shoulder supported firearms such as rifles and shotguns, and more particularly, to an improvement in or attachment to the gun stock to substantially reduce and redirect both the recoil energy and the tendency of the gun to move upward or jerk when it is fired.

It is commonly known that the recoil of a gun causes the barrel to shift in a generally upward direction and to the left. In an automatic gun which is firing rapidly, this becomes a force which is practically uncontrollable so that effective use of the weapon is not always possible after the first few shots when rapid firing is being used.

DESCRIPTION OF THE PRIOR ART

Although the prior art has attempted to reduce recoil of shoulder supported firearms with various gun stock mounted devices, none have been totally satisfactory and particularly economical to manufacture.

U.S. Pat. No. 169,465 discloses a recoil check for gun stocks employing a hinge guided, spring actuated check plate.

U.S. Pat. No. 1,088,362 discloses an adjustable butt plate for gun stocks, the plate of which is positioned relative to the gun stock for a given user of the firearm and then fixedly bolted in position.

U.S. Pat. Nos. 1,468,354 and 2,453,394 provide recoil absorbers capable of universal movement between the shoulder engaging portion and the gun stock.

U.S. Pat. No. 1,480,350 discloses a gun employing a shoulder pad which is pivoted thereto on a transverse pivot located back of the stock of the gun with means disposed on opposite sides of the pivot for adjusting the pad with respect to the stock and retaining the pad in the adjusted position.

U.S. Pat. No. 2,787,855 discloses an adjustable butt plate which may be displaced vertically and bolted in that position.

U.S. Pat. No. 3,207,496 discloses a recoil mechanism employing a variable rate spring mechanism and associated cams providing reciprocal action between the relatively movable parts of a gun stock mechanism.

U.S. Pat. No. 3,388,494 discloses a gun stock comprising two pivotal sections which respond by pivotal action to the recoil of a shot.

U.S. Pat. No. 3,754,344 discloses a gun recoil absorber employing spring tensioned lever actuated means anchored within a cavity in the gun stock. The mechanism is adapted to reciprocate in an axial direction and is operatively associated with a hollow movable end member conforming to the shape and dimensions of an adjacent conventional wooden gun stock.

U.S. Pat. No. 4,316,342 issued to the author of the present invention, discloses a recoil absorber and redirector mechanism for a shoulder held gun stock which reduces the effects of recoil by causing one of two normally aligned members mounted on the butt end of a gun stock to move relative to the other under recoil thereby redirecting the forces of recoil with the movable member resiliently absorbing most of the recoil energy which is later used to reset the mechanism to its normal inactive position.

The present invention is an improved version of U.S. Pat. No. 4,316,342 employing fewer and less expensive parts and offering improved performance and reduced cost.

U.S. Pat. No. 5,001,855, granted to the inventor of U.S. Pat. No. 4,316,342, is an improvement relating to means for adjustably mounting a recoil absorber on the butt end of a gun so that the recoil absorber can be adjustably moved up and down, crosswise, rotationally or at an angle on the stock of a gun.

SUMMARY OF THE INVENTION

In accordance with the present invention, a recoil-redirector absorber mechanism is disclosed comprising two inter-connected parts which may move relative to one another under recoil action and wherein a spring is provided to bias the parts to their normal juxtapositioned arrangement and to absorb the forces of recoil under shell explosion reaction.

It is, therefore, one object of this invention to provide an improved mechanism for the end of a gun stock of a shoulder held firearm which reduces recoil to a minimum.

Another object of this invention is to provide an improved gun stock which not only reduces to a very minimum the change of position of the muzzle of the gun in continued firing, but also relieves the shock against the shoulder of the gunner making it possible for him to maintain a stable position with a well aimed firearm under rapid firing conditions.

A further object of this invention is to provide a recoil mechanism for shoulder held firearms in which the force of recoil is directed away from the shoulder of the gunner and absorbed by a suitable shock absorbing means.

A still further object of this invention is to provide an improved recoil mechanism for applying to the end of the gun stock of a shoulder held firearm wherein the gun stock moves relative to a shoulder held attachment under recoil with the recoil absorbed by a shock absorbing means which shock absorbing means after absorbing the recoil forces uses this absorbed force to return the gun stock to its normal shoulder held position.

Another object of this invention is to provide a recoil control device for a gun stock which is readily adjustable depending on the ammunition used and the needs of a particular operator.

It is a further object of the invention to provide a fully automatic, shoulder held device for firearms which dampens recoil through absorption of the energy to substantially reduce disturbance of the gunner and the gun attitude.

It is a further object of the invention to provide a fully automatic, shoulder held device for firearms which dampens recoil through absorption of the energy to substantially reduce disturbance of the gunner and the gun attitude.

A still further object of the invention is to provide such a mechanism in a form that employs fewer and less expensive parts than related prior art mechanisms.

A still further object of the invention is to provide such a mechanism in a form that may be more readily taken apart for cleaning than prior art mechanism.

Yet another object of the invention is to provide such a mechanism in a form that enables the incorporation of a larger deflection angle, the larger angle being desirable relative to the performance of the mechanism.

Other objects and features of the invention relating to details of construction and operations will be apparent in the following description and claims.

BRIEF DESCRIPTION OF THE DRAWINGS

The present invention may be more readily described with reference to the accompanying drawings in which.

DESCRIPTION OF THE PREFERRED EMBODIMENT

Figure 1:
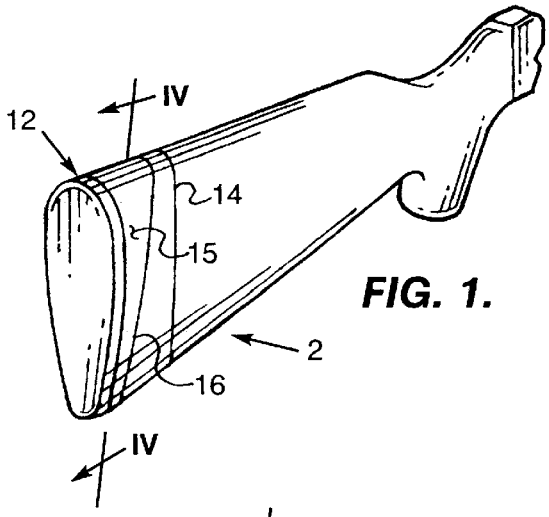
FIG. 1 is a partial perspective view of the gun stock end of a shoulder held firearm embodying the invention.

Referring more particularly to the drawings by characters of reference, FIGS. 1, 1A, 5, 6 and 7 disclose the outline of the gun stock end 10 of a standard rifle or shotgun 11 with the usual barrel, magazine and trigger not shown for simplicity purposes. The details of operation of the gun are not essential to the description of the particular invention, but in general, the firearm or gun may be a single shot or a rapid firing, relatively high powered firearm. In the design shown, the stock of the gun may be formed of a molded plastic although it can be formed of any other suitable material such as solid wood and metal.

A recoil mechanism 12 is attached to the gun butt end 13 and comprises first and second relatively movable members 14 and 15, respectively constructed and connected so that one member may be moved relative to the other under the forces of recoil.

Figure 1A:
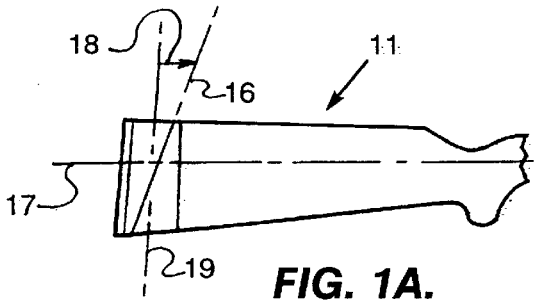
FIG. 1A is a side view of the gun stock of FIG. 1.

As shown in FIG. 1A, the two members 14 and 15 slidably abut along a plane 16 that slopes downwardly and rearwardly when the firearm is held in a firing position with its longitudinal axis 17 directed horizontally. For optimum performance of the recoil absorber and redirector mechanism the plane 16 should form a deflection angle 18 with the vertical 19 of fifteen degrees or more.

During recoil, the recoil force is directed rearwardly and downwardly at the butt of the firearm. Without the benefit of a recoil absorber and redirector mechanism, the gunner's shoulder absorbs the recoil energy; with the recoil mechanism 12 of the invention attached as shown in FIGS. 1 and 1A, the butt of the forearm 11 tends to follow the downward and rearward direction of plane 16 away from the shoulder of the gunner with a substantial part of the recoil energy being absorbed by the mechanism 12. The energy stored in the mechanism then returns the gun stock to its original position.

Figure 2:
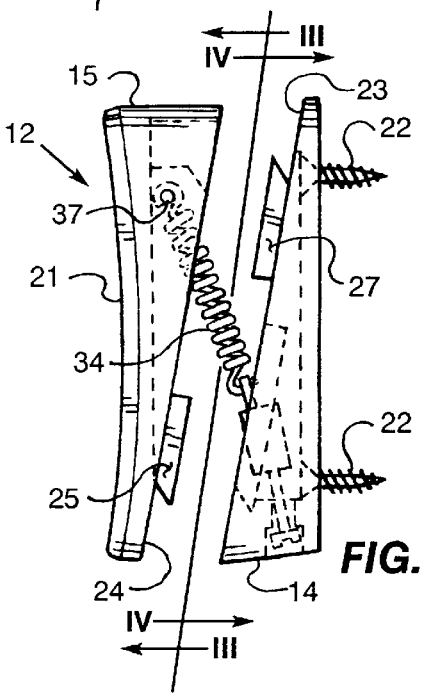
FIG. 2 is a side view of a first embodiment of the invention as viewed in the direction 2 of FIG. 1 with the mechanism shown in a partially disassembled state.
Figure 3:
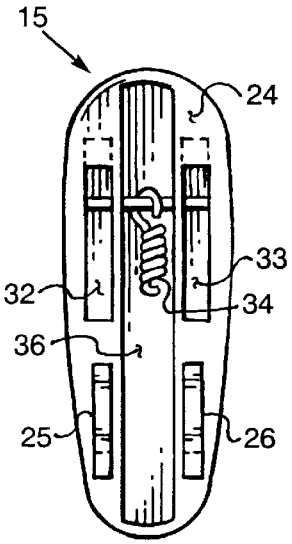
FIG. 3 is a cross-sectional view of FIG. 2 taken along line 3—3.
Figure 4:
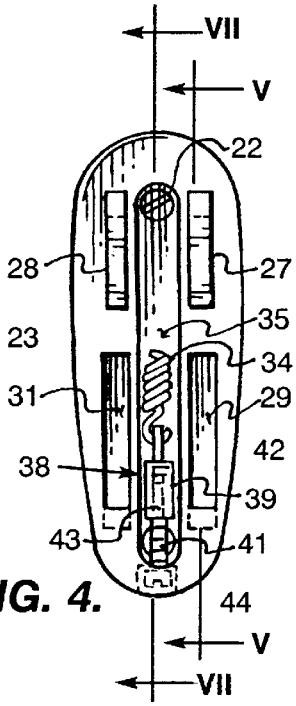
FIG. 4 is a cross-sectional view of FIG. 2 taken along line 4—4.

FIGS. 2–4 show the interior construction of a first embodiment of the invention.

As shown in FIG. 2, member 15 has a wedge-shaped form as viewed from the side that is wide at the top and narrow at the bottom while member 14 is also wedge-shaped but wide at the bottom and narrow at the top.

Member 15 has a foam or other resilient pad 21 attached to its rearward surface which bears against the shoulder of the person firing the gun, and member 14 has mounting holes through which mounting screws 22 may be passed for attachment to the butt of the firearm 11. When the mechanism is fully assembled, the slidable bearing faces 23 and 24 of members 14 and 15 respectively abut each other along plane 16 of FIGS. 1 and 1A.

The vertical alignment of the two members 14 and 15 relative to each other is sustained by means of four sets of tongue-and-groove configurations. As shown in FIGS. 2–4, member 15 has two vertically oriented tongues or tenons 25 and 26 at its lower end and member 14 has two vertically oriented tenons 27 and 28 at its upper end. Tenons 25 and 26 of member 15 fit slidably into grooves 29 and 31, respectively, of member 14 when the mechanism 12 is fully assembled while tenons 27 and 28 of member 14 fit slidably into grooves 32 and 33, respectively, of member 15.

A coil spring 34 in cooperation with the four tongue-and-groove configurations just described holds the mechanism together during rest as well as during recoil. The spring 34 operates within aligned cavities 35 and 36 of members 14 and 15, its upper end attached to a pin 37 at the upper end of member 15 and its lower end attached to a tensioning device 38 at the lower end of member 14. Tensioning device 38 comprises a rectangular block 39 and a machine screw 41. Block 39 fits slidably within cavity 35 and has an attachment hole 42 for the attachment of spring 34. It also has a longitudinal threaded bore 43 that receives the threaded end of the screw 41. The screw 41 enters bore 43 through a clearance hole in the bottom of member 14, with its head trapped in a cavity 44 so that as the screw 41 is turned into the bore 43, block 39 is drawn downwardly, increasing the tension in spring 34.

Figure 5:
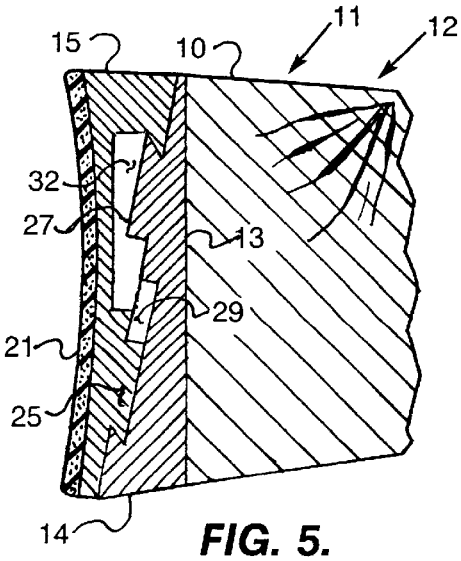
FIG. 5 is a cross-sectional view of FIG. 1 taken along a line corresponding with line 5—5 of FIG. 4 with the mechanism in its rest position.
Figure 6:
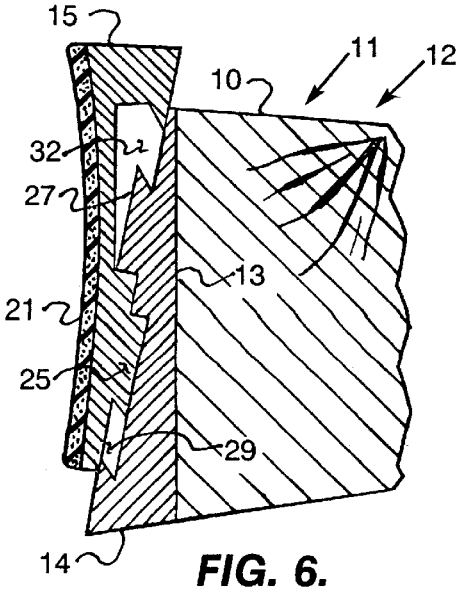
FIG. 6 is a cross-sectional view of FIG. 1 taken along a line corresponding with line 5—5 of FIG. 4 with the mechanism in its maximum displacement position during recoil.
Figure 7:
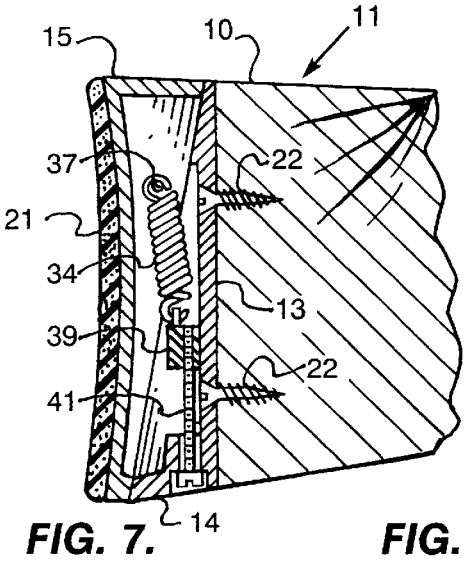
FIG. 7 is a cross-sectional view of FIG. 1 taken along a line corresponding with line 7—7 of FIG. 4 with the mechanism in its rest position.

FIGS. 5, 6 and 7 provide additional details of the construction of members 14 and 15. FIGS. 5 and 6 are cross-sections taken through tenons 25 and 27 and grooves 29 and 32, FIG. 5 showing the rest position of member 14 and FIG. 6 showing the deflected position of member 14 during recoil. FIG. 7 is a cross-section taken through the cavities 35 and 36 in which the spring 34 is mounted.

As shown in FIG. 5, tenon 27 has a wedge-shaped upper end that interlocks in the rest position with the undercut upper end of groove 32 while tenon 25 has a wedge-shaped lower end that interlocks with the undercut lower end of groove 29. Note that as shown in FIG. 7, the spring 34 urges member 14 upwardly relative to member 15 so that the wedge-shaped upper end of tenon 27 is driven upwardly into engagement with the undercut upper end of groove 23 while the undercut lower end of groove 29 is driven upwardly into engagement with the wedge-shaped lower end of tenon 25.

The spring sustains these conditions, thereby causing the two members to be held firmly together.

Now when the firearm 11 is fired, recoil force, which has both rearward and downward components at the butt end 13, causes member 14 to move generally downward relative to member 15, against the opposition of spring 34. FIG. 6 shows a terminal condition or a condition of maximum displacement in which the lower end of tenon 27 has reached the lower end of groove 32 and the upper end of groove 29 has reached the upper end of tenon 25. Any further upward movement of member 14 will be coupled directly to the gunner's shoulder. This undesirable occurrence can be prevented by an appropriate adjustment of spring 34 whereby sufficient energy is stored in spring 34 to prevent the tenons from reaching their terminal positions.

Following the recoil action just described, the energy that is stored in spring 34 is discharged as spring 34 returns member 14 to the rest position shown in FIG. 5.

The spring 34 has thus been shown to provide a threefold function. It holds the members 14 and 15 together during the rest position, it absorbs recoil energy during firing, and it restores member 14 and the butt end 13 of the gun stock 10 to the rest position.

The invention as shown in FIGS. 1 through 7 has two important advantages over the nearest prior art. First, it is less expensive to manufacture because it comprises only two inexpensive molded plastic parts, a spring and simple tensioning means. While a number of different plastics or polymers have been found satisfactory, it is preferable that the two members be made from different plastic materials to prevent galling. Secondly, the mechanism may readily be disassembled to the stage shown in FIG. 2 by simply moving member 14 downward to release the engagement of the wedged ends of the tenons and then drawing the two members apart against the resistance of the spring. This is an advantage in the event the mechanism needs to be taken apart for cleaning.

Figure 8:
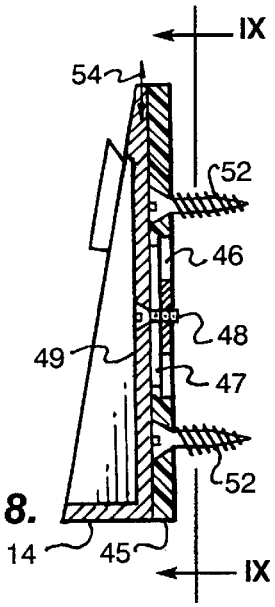
FIG. 8 is a cross-sectional view illustrating an enhanced version of the mechanism of FIGS. 2–7 incorporating an adjustment plate for raising or lowering the mechanism relative to the butt of the firearm.
Figure 9:
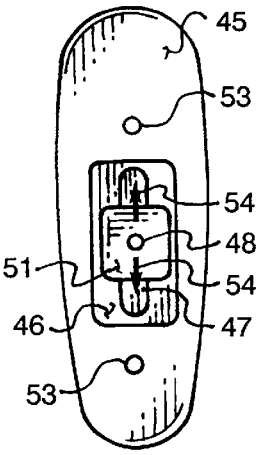
FIG. 9 is a plan view of the adjustment plate illustrated in the cross-sectional view of FIG. 8.
Figure 10:
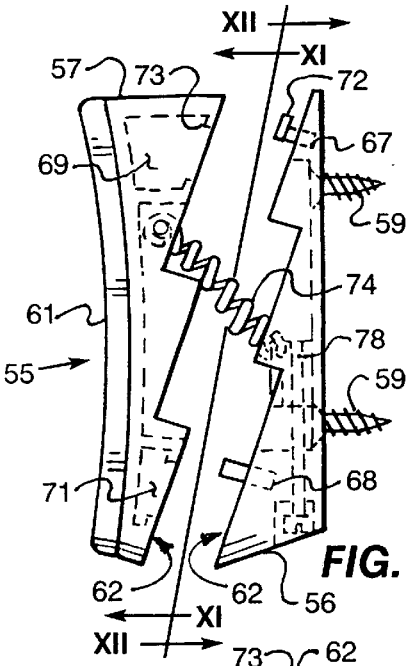
FIG. 10 is a side view of another embodiment of the invention in a partially disassembled state.
Figure 11:
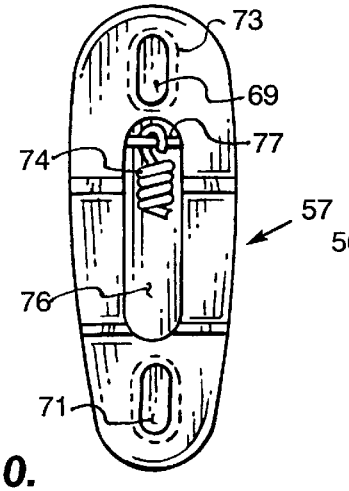
FIG. 11 is a view of FIG. 10 taken along line 11—11.
Figure 12:
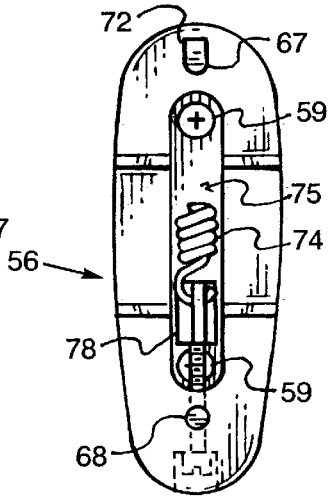
FIG. 12 is a view of FIG. 10 taken along line 12—12.

FIGS. 8 and 9 illustrate an adjustment feature that may be added to the mechanism of FIGS. 1–7 or to similar recoil mechanisms. In order to match the mechanism to different physical dimensions of the person firing the rifle or shotgun, it will be found useful to be able to move the mechanism upward or downward relative to the butt of the gun. For this purpose, an adjustable mounting plate 45 may be attached to the forward surface of member 14 as shown in FIG. 8. The mounting plate has an overall shape or outline matching that of the forward face of member 14. It has a centered rectangular depression 46 on its forward surface and a longitudinal slot 47 centered within depression 46. The mounting plate 45 is secured to member 45 by means of a screw 48 that passes through the forward wall 49 of member 14, through slot 47 and then threads into a square or rectangular slider plate 51 that fits slidably within depression 46. The adjustment plate 45 is secured to the butt of the firearm by means of two screws 52 which pass through holes 53 in plate 45.

To mount and adjust the position of the mechanism, the plate 45 is first secured loosely to member 14 by means of screw 48 and slider plate 51. The plate 45 is then secured to the butt of the firearm by means of screws 52 in an aligned and centered position. To gain access to the heads of the screws 52, member 14 may be rotated about screws 48 during the mounting of plate 45. Once the plate has been mounted, the desired position of the mechanism is obtained by aligning member 14 longitudinally, moving it upward or downward in the direction of the arrows 54 and then tightening the screw 48 to secure the desired position.

A second embodiment of the invention is shown as recoil mechanism 55 in FIGS. 10–14. The mechanism 55 again comprises a pair of normally aligned members 56 and 57 mounted on the butt end of a gun stock 58, one of which is caused to move relative to the other under recoil, with the movable member 56 absorbing most of the recoil energy.

As in the case of the first embodiment, the movable member 56 is secured to the butt of the gun stock 58 by one or more screws 59 and the other member 57 has a foam or other resilient pad 61 affixed to its rearward surface which bears against the gunner's shoulder. The members 56 and 57 may be made of plastics or metal and preferably a different polymer for each member.

The salient feature which distinguishes mechanism 55 from mechanism 12 is the stepped and segmented interface 62 between the two member, 56 and 57. The advantage of the stepped interface is that it permits the realization of a larger deflection angle (angle 18 of FIG. 1A) for a given overall (forward to rear) mechanism dimension. For example, mechanism 55 is shown with three segments 63, 64 and 65 as identified in FIG. 14. If only a single segment were to be employed with the same slope as that shown for each of the three segments, an additional dimensional increment 66 would be required. This would nearly double the overall mechanism dimension front to back. As indicated earlier, the increased deflection angle that is enabled by the segmented interface significantly improves the performance of the mechanism. While a three segment version has been shown and described, the invention is considered to cover any number of segments including two or more.

Mechanism 55 also differs from mechanism 12 in regard to the means by which the two members are held in alignment. Instead of the tongue-and-groove configurations of mechanism 12, mechanism 55 employs upper and lower alignment pins 67 and 68, which extend from member 56 into slots 69 and 71, respectively, in member 57. Pin 67 is capped by a rectangular tab 72 which extends upwardly from the end of pin 67. In the rest position of mechanism 55 the tab 72 is driven upwardly into a latching position behind a mating projection 73 at the upper end of slot 69 of member 57.

The two members 56 and 57 are held together by a spring 74, which is housed in longitudinal, aligned cavities 75 and 76 of members 56 and 57. The upper end of spring 74 is attached to a pin 77 near the upper end of member 57 and its lower end is attached to a tensioning device 78 of the same type that was described earlier, i. e. device 38 of mechanism 12.

Figure 13:
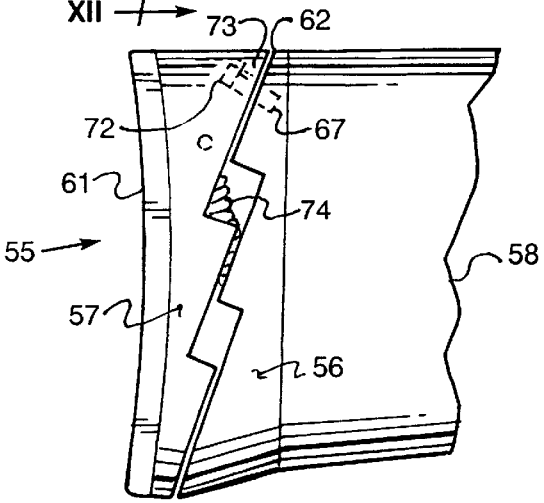
FIG. 13 is a side view showing the mechanism of FIGS. 10–12 attached to a gun stock with the mechanism in its rest position.
Figure 14:
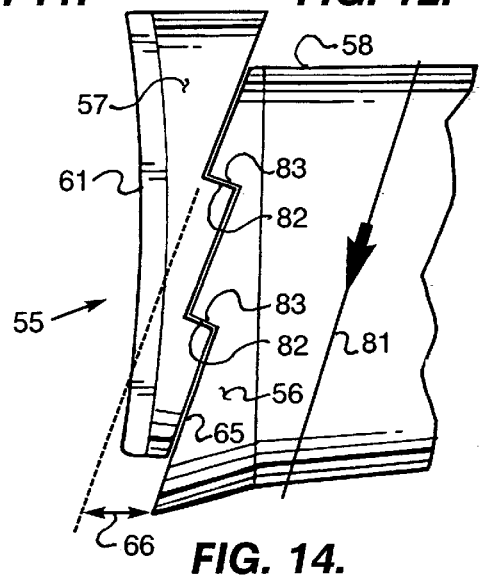
FIG. 14 is a side view showing the mechanism of FIGS. 10–13 attached to a gun stock with the mechanism in its maximum displacement during recoil.

FIG. 13 shows the mechanism 55 attached to the butt end of a gun stock 58 with the mechanism in the rest position. As in the case of mechanism 12 the spring 74 holds the two members in alignment, in this case by urging member 56 upwardly relative to member 57, its upward travel terminating when pin 67 reaches the upper end of slot 69 with its tab 72 captured behind projection 73.

Spring 74 sustains the aligned positions of members 56 and 57 as shown in FIG. 13 until the weapon is fired. The force of recoil is directed rearwardly and downwardly. These recoil force components drive member 56 and the butt end of the gun stock in the direction of line 81 which is seen to be in parallel alignment with the slopes of the interface segments 63, 64 and 65. Member 56 moves downward in the direction 81 until the tension in spring 74 balances out or until the opposing steps 82 and 83 of members 57 and 56, respectively come into contact with each other. Ideally, spring tension should be adjusted so that the relative motion of the two members stop just short of contact between steps 82 and 83.

Following recoil, the energy absorbed by spring 74 returns the mechanism to the rest position of FIG. 13.

Although but a few embodiments of the invention have been illustrated and described, it will be apparent to those skilled in the art that various changes and modifications may be made therein without departing from the spirit of the invention or from the scope of the appended claims.

What is claimed is:

1. A recoil absorber and redirector mechanism for a shoulder held gun stock comprising:

a first member arranged to be rigidly affixed to the rear end of a gun stock, a second member slidably attached to said first member and adapted for supporting the gun stock against the shoulder of the user, said first and second members being provided with abutting sliding surfaces extending downwardly and rearwardly from a point on the top of the gun stock across its width toward a point below the shoulder of the user, tongue and groove means serving to guide said first and second members in their relative movement along said abutting sliding surfaces and providing limit positions in both directions with a simple stop at the limit position in one direction and a wedged stop at the limit position in the other direction, a spring interconnecting said first and second members for normally biasing them to a given aligned rest position and under recoil of the gun on which they are affixed resiliently resisting their relative movement caused by recoil, the spring absorbing thereby at least a part of the recoil energy, said sliding surfaces redirecting the effects of recoil from a direction longitudinally of the gun stock to a direction angularly downwardly and rearwardly thereof and deflecting at least a component of the recoil energy downwardly and rearwardly away from the head of the user, and upon termination of recoil, said spring causing said first member to return to the rest position in alignment with said second member, driving said tongue and groove means to its wedged stop limit position, said spring then holding said tongue and groove means in said wedged stop position and thereby securing said mechanism in its rest position until the gun is fired again.

2. The recoil absorber and redirector mechanism of claim 1 in further combination with:

an adjustable mounting plate, said mounting plate being securely attached to the butt end of the gun, and said first member being adjustably secured to said mounting plate, whereby the vertical position of said first member and of said recoil mechanism may be adjusted relative to the butt end of the gun to which the mechanism is attached.

3. The recoil absorber and redirector mechanism of claim 1 in further combination with a tensioning device for adjusting the tension in said spring.

4. A recoil absorber and redirector mechanism for a shoulder held gun stock comprising:

a first member arranged to be rigidly affixed to the rear end of a gun stock, a second member slidably attached to said first member and adapted for supporting the gun stock against the shoulder of the user, said first and second members being provided with segmented abutting sliding surfaces, said segmented surfaces comprising two or more identically sloped segments in a stepped arrangement, with each segment sloping downwardly and rearwardly and in parallel with a line that extends from a point on the top of the gun stock across its width toward a point below the shoulder of the user, pin and slot means slidably interconnecting said first and second members, said pin and slot means serving to guide said first and second members in their relative movement along said abutting sliding surfaces and providing limit positions in both directions with a simple stop at the limit position in one direction and a captured stop at the limit position in the other direction, a spring interconnecting said first and second members for normally biasing them to a given aligned rest position and under recoil of the gun on which they are affixed resiliently resisting their relative movement caused by recoil, the spring absorbing thereby at least a part of the recoil energy, said sliding surfaces redirecting the effects of recoil from a direction longitudinally of the gun stock to a direction angularly downwardly and rearwardly thereof and deflecting at least a component of the recoil energy downwardly and rearwardly away from the head of the user, and upon termination of recoil, the energy stored in said spring during recoil causing said first member to return to the rest position in alignment with said second member and driving said pin and slot means to its captured limit position, said spring then holding said pin and slot means in said captured limit position and securing said mechanism in its rest position until the gun is fired again.

5. The recoil absorber and redirector mechanism of claim 4 in further combination with:

an adjustable mounting plate, said mounting plate being securely attached to the butt end of the gun, and said first member being adjustably secured to said mounting plate, whereby the vertical position of said first member and of said recoil mechanism may be adjusted relative to the butt end of the gun to which the mechanism is attached.

6. The recoil absorber and redirector mechanism of claim 4, said segmented surfaces comprising three identically sloped segments in a stepped arrangement.

7. The recoil absorber and redirector mechanism of claim 4 in further combination with a tensioning device for adjusting the tension in said spring.

* * * * *